US012286878B2

(12) United States Patent
Reppucci

(10) Patent No.: US 12,286,878 B2
(45) Date of Patent: Apr. 29, 2025

(54) WELL WATER LEVEL MONITOR, PUMP CONTROL AND PROTECTION SYSTEM

(71) Applicant: Joseph E. Reppucci, Wakefield, RI (US)

(72) Inventor: Joseph E. Reppucci, Wakefield, RI (US)

( * ) Notice: Subject to any disclaimer, the term of this patent is extended or adjusted under 35 U.S.C. 154(b) by 0 days.

(21) Appl. No.: 18/211,711

(22) Filed: Jun. 20, 2023

(65) Prior Publication Data

US 2024/0426207 A1 Dec. 26, 2024

(51) Int. Cl.
*E21B 47/047* (2012.01)
*E21B 43/12* (2006.01)
*E21B 47/06* (2012.01)

(52) U.S. Cl.
CPC ..... *E21B 47/047* (2020.05); *E21B 43/128* (2013.01); *E21B 47/06* (2013.01)

(58) Field of Classification Search
CPC ..... E21B 47/047; E21B 47/06; E21B 43/128
See application file for complete search history.

(56) References Cited

U.S. PATENT DOCUMENTS

| | | | | |
|---|---|---|---|---|
| 4,187,912 | A * | 2/1980 | Cramer | E21B 47/047 166/107 |
| 10,030,502 | B1 * | 7/2018 | Singer | G01F 23/804 |
| 2005/0217350 | A1 * | 10/2005 | Jabusch | E21B 47/008 73/64.55 |
| 2006/0131028 | A1 * | 6/2006 | Burris | G01F 23/296 166/372 |
| 2011/0224907 | A1 * | 9/2011 | Chalifoux | E21B 47/06 374/E7.004 |
| 2015/0330211 | A1 * | 11/2015 | Kabatek | E21B 23/08 166/250.01 |
| 2016/0237814 | A1 * | 8/2016 | Fripp | E21B 43/121 |
| 2018/0112658 | A1 * | 4/2018 | Fosmark | F04D 15/0218 |

* cited by examiner

*Primary Examiner* — Brad Harcourt
(74) *Attorney, Agent, or Firm* — Armis IP Law, LLC

(57) ABSTRACT

A well monitor device has a monitoring and control application that determines a depth of water in a well, and over time tracks demand and replenishment characteristics of the well. A sensor adjacent to a pump in the well detects a hydrostatic pressure indicative of depth. The sensor is connected to a monitor for controlling the well pump based on the depth by controlling a power supply to the pump. The monitor also alerts a user and disables the pump based on thresholds of depth approaching a potentially damaging level. The monitor system maintains a network interface for tracking individual well depth characteristics, and also for tracking other wells based on geographic location for identifying trends of multiple wells drawing from a common aquifer.

18 Claims, 6 Drawing Sheets

506 504

| | | | | | | | | | | |
|---|---|---|---|---|---|---|---|---|---|---|
| WELL DEPTH (FT) | | | | 150 | | | | | | |
| CASING DIAMETER (INCHES) | | | | 6 | | | | | | |
| WARNING ALARM DEPTH (FT) | | | | 100 | | | | | | |
| SHUTDOWN ALARM DEPTH (FT) | | | | 125 | | | | | | |
| MAXIMUM PUMP OPERATION (MINS) | | | | 25 | | | | | | |
| DATE | TIME | DEPTH TO WATER (FT) | WELL DEPLETION RATE (GPM) | WELL REFRESH RATE (GPM) | AQUIFER LEVEL AT REST (FT) | WARNING ALARM TRIGGERED? | SHUTDOWN ALARM TRIGGERED? | EXCESSIVE PUMP OPERATION ALARM? | PUMP RUNNING? | PUMP OPERATING MINUTES |
| 4/12/2023 | 8:00:00 AM | 60.00 | 0.00 | 0.00 | 60.00 | NO | NO | NO | NO | 0 |
| 4/12/2023 | 8:05:00 AM | 61.00 | -3.77 | 0.00 | 60.00 | NO | NO | NO | YES | 5 |
| 4/12/2023 | 8:10:00 AM | 61.25 | -0.94 | 0.00 | 60.00 | NO | NO | NO | YES | 10 |
| 4/12/2023 | 8:15:00 AM | 62.58 | -5.01 | 0.00 | 60.00 | NO | NO | NO | YES | 15 |
| 4/12/2023 | 8:20:00 AM | 63.00 | -1.58 | 0.00 | 60.00 | NO | NO | NO | YES | 20 |
| 4/12/2023 | 8:25:00 AM | 64.20 | -4.52 | 0.00 | 60.00 | NO | NO | YES | YES | 25 |
| 4/12/2023 | 8:30:00 AM | 64.05 | 0.00 | 0.00 | 60.00 | NO | NO | NO | NO | 0 |
| 4/12/2023 | 8:35:00 AM | 64.01 | 0.00 | 0.15 | 60.00 | NO | NO | NO | NO | 0 |
| 4/12/2023 | 8:40:00 AM | 63.97 | 0.00 | 0.15 | 60.00 | NO | NO | NO | NO | 0 |
| 4/12/2023 | 8:45:00 AM | 64.58 | -2.30 | 0.00 | 60.00 | NO | NO | NO | YES | 5 |
| 4/12/2023 | 8:50:00 AM | 65.02 | -1.66 | 0.00 | 60.00 | NO | NO | NO | YES | 10 |
| 4/12/2023 | 8:55:00 AM | 66.00 | -3.69 | 0.00 | 60.00 | NO | NO | NO | YES | 15 |
| 4/12/2023 | 9:00:00 AM | 67.00 | -3.77 | 0.00 | 60.00 | NO | NO | NO | YES | 20 |
| 4/12/2023 | 9:05:00 AM | 68.50 | -5.65 | 0.00 | 60.00 | NO | NO | YES | YES | 25 |
| 4/12/2023 | 9:10:00 AM | 70.00 | -5.65 | 0.00 | 60.00 | NO | NO | YES | YES | 30 |
| 4/12/2023 | 9:15:00 AM | 72.00 | -7.54 | 0.00 | 60.00 | NO | NO | YES | YES | 35 |
| 4/12/2023 | 9:20:00 AM | 72.00 | 0.00 | 0.00 | 60.00 | NO | NO | NO | NO | 0 |
| 4/12/2023 | 9:25:00 AM | 72.00 | 0.00 | 0.00 | 60.00 | NO | NO | NO | NO | 0 |
| 4/12/2023 | 9:30:00 AM | 72.00 | 0.00 | 0.00 | 60.00 | NO | NO | NO | NO | 0 |

502

500

FIG. 5

WELL WATER LEVEL MONITOR, PUMP CONTROL AND PROTECTION SYSTEM

BACKGROUND

Running, potable (drinkable, batheable) water is a resource often taken for granted in modern civilization. Much of this water is sourced from aquifers, which are geological structures that store and convey water underground. Aquifer water is accessed by digging or drilling a well to a depth at or below the aquifer. Other than desalinization, which is an energy intensive process used in excessively arid or barren regions, most home and municipal water is drawn from freshwater wells. While many municipalities employ a centralized network of wells and storage tanks for providing water to residents, dwellings in more rural or sparse areas, as well as many dwellings with access to municipal water supplies, employ a well specific to the dwelling for demand therein. Many adjacent dwellings employ separate wells that may often draw from a common aquifer. Some of these wells draw water for irrigation purposes, feeding of livestock, filling of pools and ponds, etc., in addition to potable uses.

SUMMARY

A well monitoring and control system incorporates a monitoring and control application that continuously measures and records a depth of water in a well, and, over time, tracks withdrawal and replenishment rates of the well. A sensor adjacent to a pump in the well detects a hydrostatic pressure indicative of depth. The sensor is connected to a monitor. The monitor first alerts a user via an alarm at a predetermined low water depth threshold, and then, based on a still deeper predetermined water depth threshold, disables the pump by terminating the power supply to the pump motor. The deeper pump shutoff depth is selected to avoid potentially damaging the pump, or threatening the availability of the aquifer. The monitor also would disable the pump in the event that the pump operates for an excessive predetermined period of time, potentially indicating a leak in the dwelling water system. During periods when the well pump does not operate (e.g., overnight) the monitoring system would record the well recharge rate, which, when stabilized, would indicate the level of water in the aquifer outside of the well and the refresh rate over time of that said well. The monitor system maintains a network interface and connects to an internet platform for continuously tracking and recording individual well depth characteristics, and also for tracking other wells based on geographic location for identifying trends of multiple wells drawing from a common aquifer. Users would have access to the internet platform to view and retrieve historical data reports.

Groundwater conservation offers a range of benefits to the environment and human societies. Groundwater is a vital source of freshwater in many parts of the United States. Groundwater conservation can help ensure a sustainable water supply for future generations, as about 1 in 7 American residents get their drinking water from a private well. The disclosed approach allows users to track and conserve the supply of groundwater, which can be vulnerable to all consumers of a shared aquifer during times of drought. Combined information from a network of monitored wells as disclosed herein can be used to track groundwater flow and aquifer levels. This allows for tracking of reduction in water levels and many other factors. Once this system is installed, network provided aquifer monitoring data provides several benefits, including the early detection of changes in the groundwater levels, aquifers, and flow rates. This can help identify potential problems such as groundwater depletion, or saltwater intrusion in coastal communities.

Aquifer monitoring can help water managers make better decisions for allocating water resources. By understanding groundwater availability and refresh rates, residential homeowners can more effectively balance the needs of different uses and protect the sustainability of the aquifer. By identifying potential problems earlier, homeowners can take proactive steps to address issues and concerns before they become more expensive to fix.

Configurations herein are based, in part, on the observation that residential wells for servicing an individual dwelling have wide variances in performance based on a depth of the well and on the depth, porosity and permeability of the aquifer from which it draws water. In-ground wells are formed from a bore hole drilled to a depth sufficient to reach an aquifer potable water source in the ground. A well casing pipe is cemented into the well bore with perforations or a screened section within the potable water depth range of the aquifer. A pump is disposed near the bottom of the well adjacent to the casing perforations or screened section. The depth of the pump within the well defines a column of water available to the pump. Pump operation draws from this column of water, potentially reducing the height of water above the pump. Unfortunately, available approaches to well management suffer from the shortcoming that they cannot accurately detect a low water level in the water column above the pump and cannot interrupt power to the pump motor to avoid either damage to the pump or limiting the availability of water to wells within the same aquifer. The water level might drop to the point at or below the well pump, and the pump may draw in air during the pump cycle. Or, when the pump turns on, the water level in the well can drop to a low level near the bottom of the well, during which time sand and sediment can be sucked into the pump, causing excessive wear, excessive electricity costs, and sand and sediment to clog the pump or well system. These low water level conditions can result in premature pump motor burnout, pump failure, and/or reduced flow rates and water quality.

Accordingly, configurations herein substantially overcome the shortcomings of known well operation by providing a depth sensor and monitor that determines and tracks the depth of water in the well to control pump operation based on a determination of a satisfactory depth. The monitor device includes an on-site module enclosure including the monitor and monitor circuit hardware, a sensor for well immersion adjacent to the well pump, and an interface to a public access network such as the Internet to a private platform and software for data acquisition, storage, user GUI (graphical user interface) access, notifications, analytics and reporting from multiple well locations. The user interface will allow two-way communication with the control module, such that users may initiate a bypass of the control system during periods of monitoring system maintenance, or to initiate a pump shutdown for pump or piping maintenance or repair.

In further detail, configurations herein disclose a well monitor device, including a depth sensor adapted to be disposed in a well having a pump, such that the depth sensor is configured to send a depth signal in response to stimuli in the well, and a monitor circuit. The depth sensor connects to the monitor circuit for transmitting the depth signal to the monitor circuit, and an interface to a pump control is responsive to the monitor circuit for selectively energizing and terminating power to the pump.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIG. 5 shows an accumulation of well data by the monitor device of FIGS. 1-4.

DETAILED DESCRIPTION

Configurations below depict an example implementation of the well monitoring device deployed at a plurality of dwellings for monitoring individual wells and gathering data of multiple wells for longevity of individual well pumps and trending analysis of aquifers supporting a plurality of wells.

Figure 1:
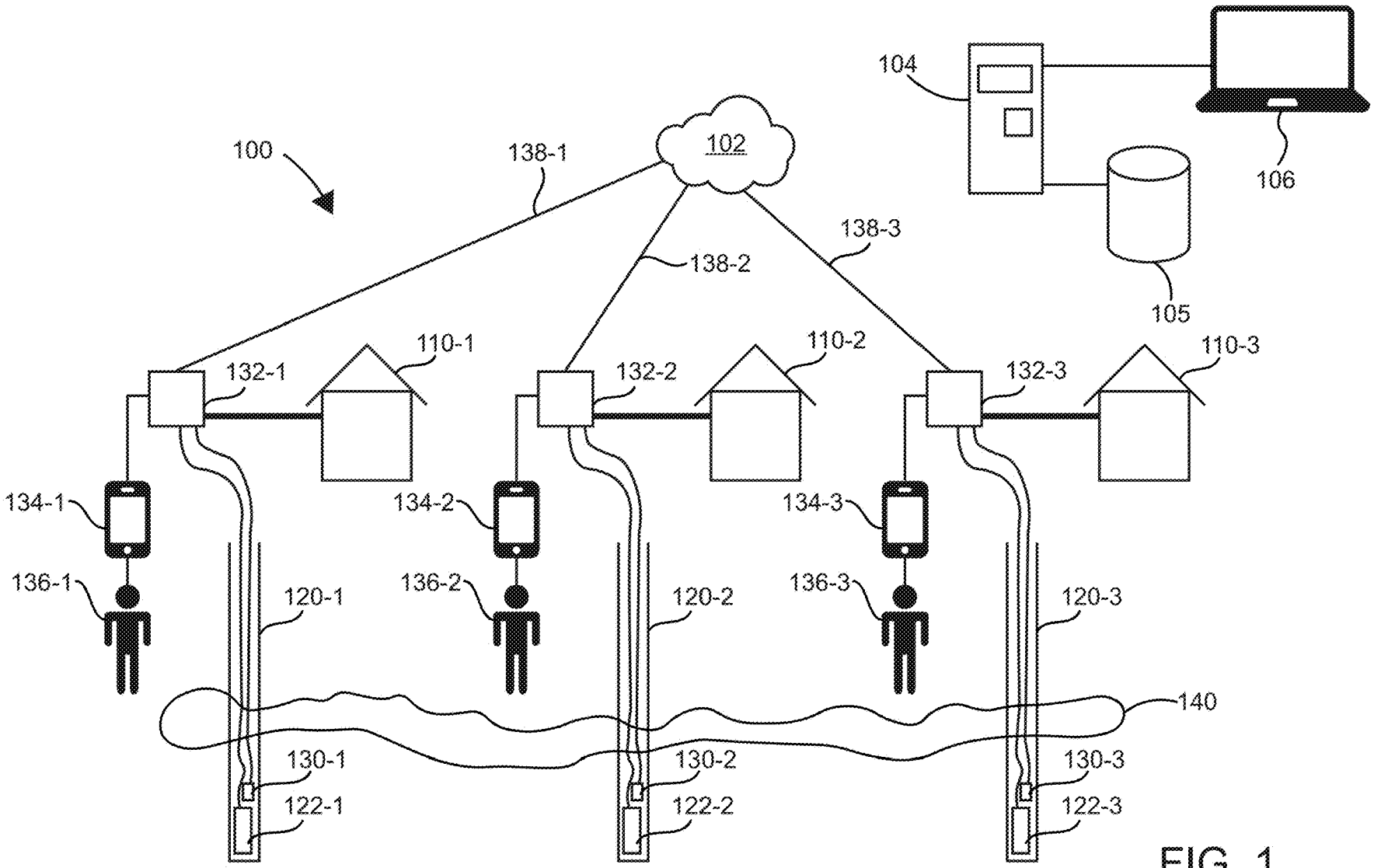
FIG. 1 is a context diagram of a water supply environment employing wells for domestic water supply.

FIG. 1 is a context diagram of a water supply environment 100 employing wells for domestic water supply. Referring to FIG. 1, the water supply environment 100 includes a plurality of dwellings 110-1 . . . 110-3 (110 generally). Each dwelling 110 has a well 120-1 . . . 120-3 (120 generally) and a respective well pump (pump) 122-1 . . . 122-3 (122 generally). For each well, a depth sensor 130-1 . . . 130-3 (130 generally) in the well connects to a respective monitor device (monitor) 132-1 . . . 132-3 (132 generally) adjacent the dwelling 110. Each monitor 132 includes an interface to a user device 134-1 . . . 134-3 (134 generally) of a user 136-1 . . . 136-3 (136 generally), and a network interface 138-1 . . . 138-3 (138 generally) to a public access network 102.

The user device 134 renders a GUI (Graphical User Interface) for data access and pump control of the corresponding pump 122 for the dwelling. A central server 104 having a database 105 is in communication with the public access network 102 for trending analysis of multiple wells, via a regional interface on a rendering device 106. The user device 134 interface and network interface may be the same WiFi®, ethernet and/or cellular data interface. In operation, the monitor 132 monitors and controls pump 122 operation based on the depth sensor 130 for energizing the pump, as described further below. Each well 120 descends to a depth sufficient to meet one or more aquifers 140, which are collections of porous and permeable rock, clay or other conglomerate which allow water to flow into the well through well casing perforations and thus fill up the water column above the pump 122 at varying rates. Neighboring wells are likely to share the same aquifer 140.

Figure 2:
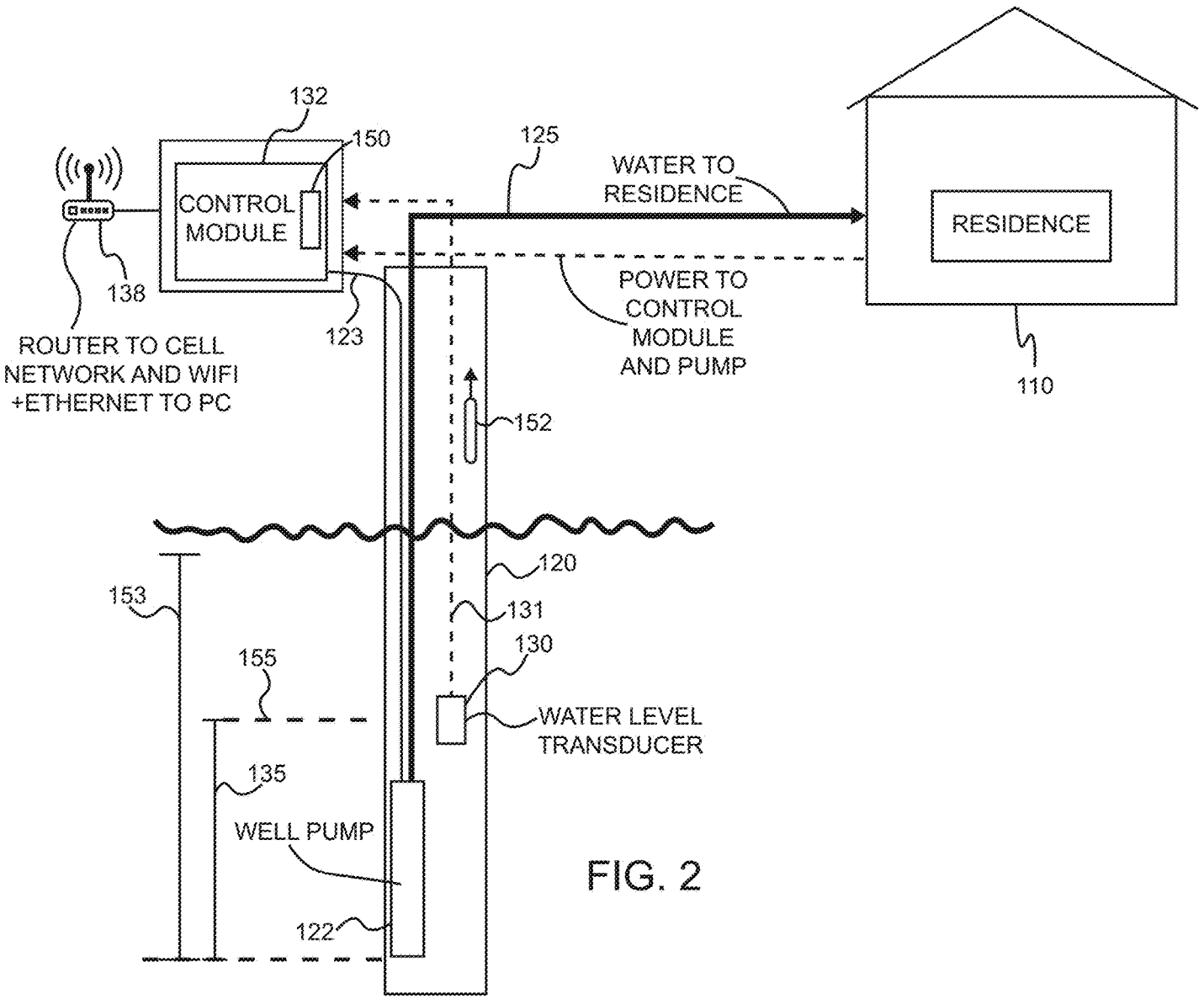
FIG. 2 shows a schematic diagram of the monitor device deployed at a dwelling as in FIG. 1.

FIG. 2 shows a schematic diagram of the monitor device 132 deployed at a dwelling 110 as in FIG. 1, either in the dwelling 110 or appurtenant the well 120. The monitor device 132 takes the form of a control module and a monitor circuit 150 for performing electrical switching and logic, usually in an enclosure or containment for temperature/weather resistance if outside Referring to FIG. 2, in an individual deployment, the well monitor device 132 employs a depth sensor 130 adapted to be disposed in a well 120 having a pump 122, such that the depth sensor 130 is configured to send a depth signal 152 in response to stimuli in the well, typically based on hydrostatic pressure. The depth sensor 130 connects to the monitor circuit 150 via a low voltage signal cable 131 for transmitting the depth signal 152 to the monitor circuit 150. The monitor 132 also includes an interface to a pump control, such that the interface is responsive to the monitor circuit 150 for energizing the pump.

In an example configuration, the sensor 130 is a pressure sensor responsive to hydrostatic pressure in the well based on a depth of an aquifer supply sourced by the well. The depth signal is a variable electric signal having a value proportional to a depth 153 of a liquid (water) in the well.

A pump power cable 123 provides power to the pump 122 in the well 120, and is adapted to energize the pump by conducting electrical power to the pump, typically 120 or 240 VAC. A water supply pipe 125 from the pump 122 accompanies the power cable, usually in a bound bundle. The signal cable 131 is supported by the pump discharge pipe and pump motor power cable 123 and connected to the depth sensor at a predetermined position along the pump discharge pipe defined by a distance 135 above the pump 122 in the well 120. The difference between the maximum water level within the well and the depth sensor 130 needs to be accommodated and calibrated for the depth detected at the location 155 of the sensor 130. Any suitable depth may be selected, and will vary between wells. The effective depth is driven by the sensitivity and calibration of the pressure sensor 130, which may be sensitive and calibrated to depth ranges of up to 500 feet below ground, and deeper.

Figure 3:
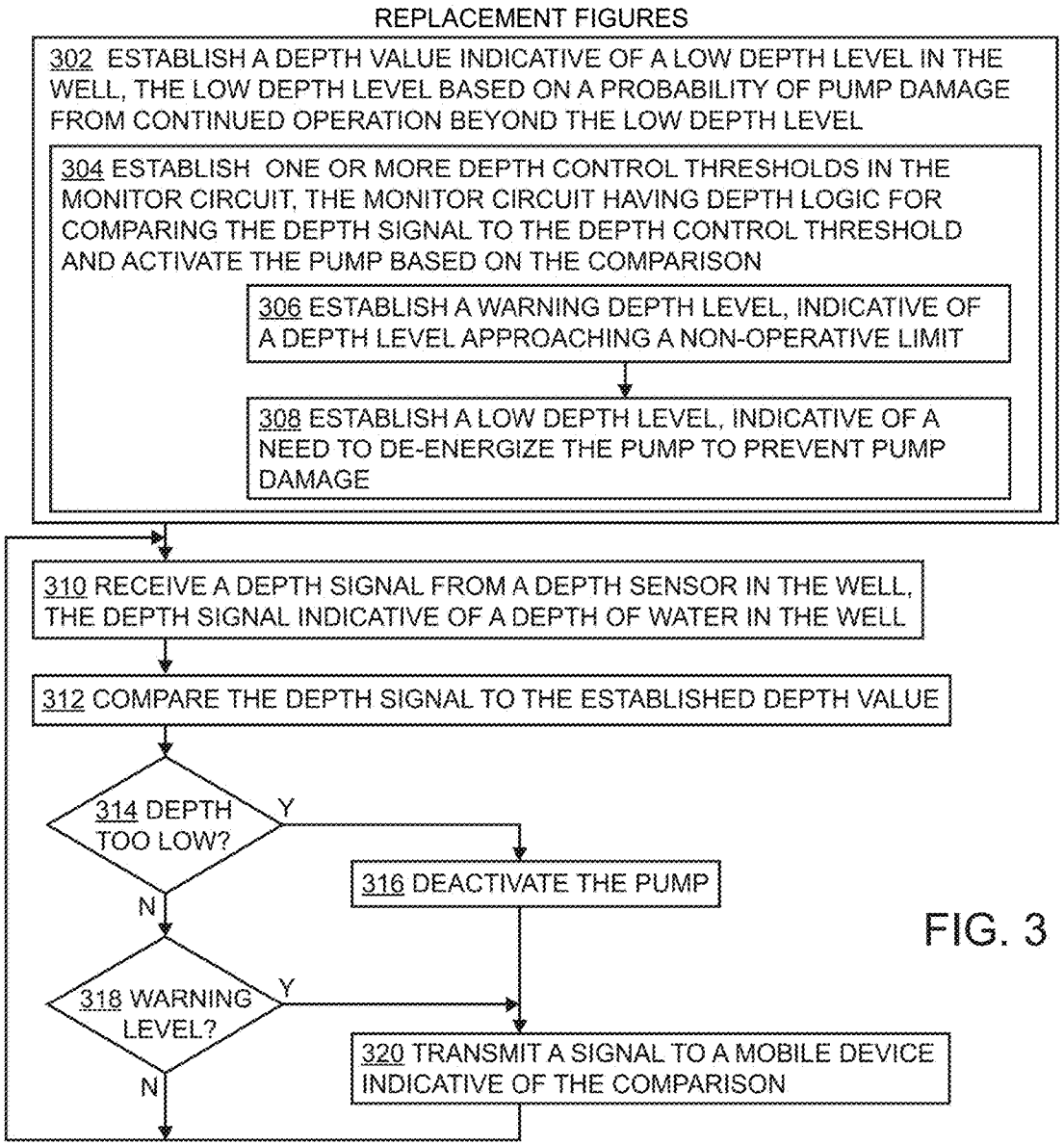
FIG. 3 shows a flowchart of monitor operation in the monitor device of FIG. 2.

FIG. 3 shows a flowchart 300 of monitor operation in the monitor device of FIG. 2. Referring to FIGS. 1-3, at step 302, the monitor 132 establishes a depth value indicative of a low depth level in the well, where the low depth level based on a probability of pump damage from continued operation beyond the low depth level. As alluded above, a low water depth may burden the pump and motor because greater silt and sediment from the aquifer tends to erode the pump and/or introduce air into its suction.

The example configuration includes one or more depth control thresholds in the monitor circuit 150, as depicted at step 304. The monitor circuit 150 has depth logic for comparing the depth signal 152 to the depth control threshold, and for activating or de-activating the pump based on the comparison. In the example configuration, the established depth value may define a plurality of depth values including a warning depth level, indicative of a depth level approaching a non-operative limit, as shown at step 306, and a lower depth level, indicative of a need to de-energize the pump to prevent pump or motor damage, as depicted at step 306. Conversely, if/when the water depth in the well is sufficiently deep, the monitor circuit 150 can reactivate the pump.

Once depth settings are established and the depth sensor 130 calibrated, the monitor 132 continuously receives depth signals 152 from the depth sensor in the well, indicative of a current depth of water in the well, as depicted at step 310. Any suitable signal representation may be employed, such as a continuous voltage, current, sinusoidal, patterned, or periodically polled/packet transported signal of a suitable interval. The monitor circuit 150 compares the depth signal 152 to the established depth value(s), as disclosed at step 312, for invoking a remedial action based on the comparison. Pump operation can therefore be gauged with water demand to operate when depth levels are optimal, particularly if the dwelling 110 has a tank or storage capability to modulate demand.

A check is performed, at step 314, to determine if the depth is too low (at or below the minimum depth threshold of water above the pump), and if so, deactivating the pump, as depicted at step 316. A further check is performed to determine if the water has fallen to or below a warning level, as shown at step 318. If so, the remedial action is to transmit a signal to a mobile device indicative of the comparison, as depicted at step 320.

Figure 4:
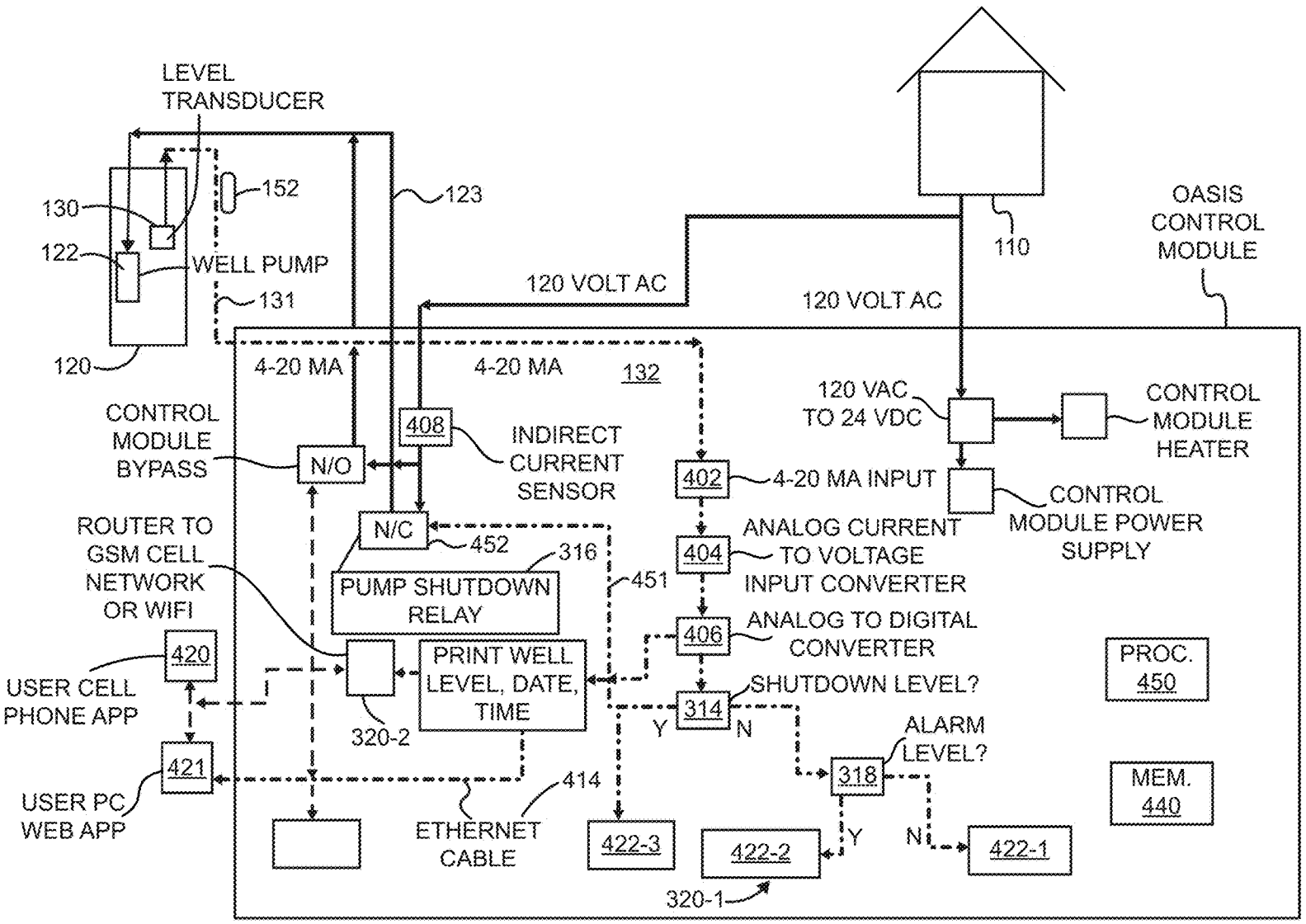
FIG. 4 shows a data flow diagram of well monitoring according to the flowchart of FIG. 3.

FIG. 4 shows a data flow diagram of well monitoring according to the flowchart of FIG. 3. Referring to FIGS. 1-4, the proposed active residential water well and/or storage tank monitoring and control system improves upon present technology. Existing systems focus primarily on passive monitoring and recording of water levels in residential, community, commercial, industrial, and environmental water wells and/or storage tanks. The data recorded by the disclosed approach is more useful to well owners and operators, as well as community aquifer protection officials, for minimizing the chance of pump and motor damage and associated high energy costs, and for understanding aquifer availability and performance, and for long-term planning and conservation purposes. Groundwater conservation offers a range of benefits to the environment and human societies. Groundwater is a vital source of freshwater in many parts of the United States. Groundwater conservation can help ensure a sustainable water supply for future generations, as about one in eight American residents get their drinking water from a private well. This system is designed to allow the users to track and conserve groundwater, which can be vulnerable to the individual users and the other users of a shared aquifer during times of drought. With the combined information from the network of systems, we will be able to track groundwater flow and aquifer levels, therefore allowing for the tracking of reduction in water levels and other factors. Aquifer monitoring can help water managers make better decisions about allocating water resources.

The disclosed approach improves upon existing systems by not only monitoring and recording water well levels, but, in addition, by providing immediate real-time active feedback and well control to its users. This more active system would provide immediate benefits over existing systems. For example, the proposed automated well control system could conserve water in times and areas where water may be limited or scarce. This would be especially beneficial for residences and other users with irrigation systems and/or alternative sources of potable water, and for commercial and industrial users whose water use may be discretionary or nonessential. In addition, the disclosed system would minimize potential well pump and motor damage for residential potable water or irrigation systems, which might otherwise be unprotected or controlled by timers in existing systems, and which do not incorporate automatic alarms and pump shut-downs when water levels may diminish beyond preprogrammed levels within a well 120. The proposed system also would warn well owners and operators whenever a well pump 122 motor operates for an excessively long period of time, indicating the potential for a leak and water damage in a home. The proposed system includes depth logic to calculate and record well refresh rates and aquifer water levels outside of wells during periods when pumping has not occurred, for example, overnight. Region-wide aquifer data from multiple wells 120-N provides useful information for aquifer protection agencies and municipalities to conserve discretionary water usage in arid areas and/or during times of drought. The presently available well monitoring systems only monitor water table surface elevations with ultrasonic or other instruments that can only measure down to 30 or 40 feet below the land surface. The proposed system measures the entire water column height above a pressure transducer hundreds of feet below the land surface. This allows detection and measurement of water table surface elevations much deeper than existing systems. In present technology systems, such as those using propagated signals such as sonar, radar, mechanical, displacement and similar devices detect water level surfaces based on a depth below the device (e.g., below the ground surface, top of well casing or tank topo). The claimed approach measures pressure based on a water level above the pump, (relative to the pump/sensor), rather than relative to the ground surface. The existing approach tends to decline in accuracy for water surface depths of approximately 50 feet or more of depth below the surface as the signal fails to propagate for detection.

Existing well monitoring systems only provide one-way communication between the well monitor and a logging and recording system. The proposed system provides two-way communication between the control monitor and user, whereby the user can actively control the well pump operation.

In the data flow depicted in FIG. 4, the depth sensor 130 includes a piezo-resistive membrane element, or any other appropriate type of pressure transducer, and the depth signal 152 is a variable current signal based on hydrostatic pressure exerted on the element. The depth sensor 130 is deployed in proximity to the well pump 122 by attaching the depth sensor signal cable to the pump discharge pipe 125 at a predetermined distance 155 from the pump. Ideally, the depth sensor is a field-adjustable analog pressure transducer pre-calibrated for a desired well water level range, which can then be calibrated for sensing the depth based on the water surface level above the sensor. Typical well pumps are installed by lowering a bundle of the power cable 123 and a water supply pipe 125. The signal cable 131 is substantially smaller than the power and supply pipes, and does not impose significant incremental space constraints. In actual deployment, the signal cable 131 incorporates a power wire to the transducer, a signal wire back to the control module and a desiccant-protected vent tube from the transducer. The vent tube helps negate the effects of atmospheric pressure changes.

A typical depth sensor 130 is a transducer with a 24-volt power input and variable 4-20 milliamp output signal. Variable voltage may also be used. The transducer is rated for operating pressures up to approximately 200 pounds per square inch absolute (PSIA), which is equivalent approximately to 500 feet of water depth, sufficient for most residential wells. Preferably, the transducer is capable of periodic "zero drift" and "span drift" calibration with portable field or shop measurement equipment and tools. The transducer then produces the depth signal 152 proportional to the height of water within a well above the transducer.

The signal cable 131 emerges from the well and travels to the monitor, physically contained in an enclosure located in or appurtenant to the well 120 As a product, the contents of the packaging containing the monitoring system components would also include instructions and/or a disc/Mobile Phone Application for accessing and using the monitoring and logging software user interface by cellular phone or Internet. The monitor 132 package would include connections for customer-provided ethernet cable and power supply 138. The ethernet and power cables to the control module would be readily available commodity items that would not be included with the monitoring system.

The full package would not require integration in the well pump 122 manufacturing, but rather integrated with any suitable well pump assembly either as a new or retrofit installation. Pump motor control is provided through a switch or relay controlled by the monitor, which would allow or inhibit electrical power to the well pump. A current sensing ammeter detects when the well pump motor is running and provides an alarm if excessive pump operation were to be an indication of a residential leak or damage.

The analog signal cable 131 from the pressure transducer leads to the control module enclosure (monitor 132) at the top of the well. In the example configuration, a transducer suspension cable and vent tube with hydrophobic filter are combined into a single narrow bundle with the signal cable, and are attached to the pump discharge pipe (the pump power and water supply pipe diameters are substantially larger than the transducer cable and vent tube bundle).

In the example configuration, the signal cable 131 transports the depth signal 152 to the monitor 132 as a 4-to-20 milliamp current signal 402. A current-to-voltage converter 404 and a 10-, 12- or 16-bit analog-to-digital signal converter 406 allow computation of a water depth as in FIG. 3 using micro-processor, programmable logic controller (PLC) or micro-controller circuit board with relay switches. The controller logic, as depicted in FIG. 3, allows determination of at least 1) an alarm 320, 2) a pump power shut-off 316, and 3) a control system bypass. The monitor 132 further includes an ammeter 408 installed in series in the well pump motor power circuit to detect when the pump motor is on and off and would provide an input signal to the controller. This may take the form of a current sensor engaged with the pump power cable, such that the current sensor is configured to provide a signal indicative of pump operation based on current draw. This information may also be written to a database table for storing an indication of timed intervals of pump operation and a depth level in the well, shown further below in FIG. 5. The current sensor is preferably a non-contact current detector which may be attached in a non-conductive manner to the exterior of the pump power cable 123, to avoid pump circuit rewiring. The monitor 132 enclosure is typically housed within a weather-proof and lockable control enclosure box, but may be mounted in the dwelling in proximity to the pump power cable 123.

User interfacing and controls are facilitated by the interface 138 to a public access network 102. The monitor 132 includes processor based instructions for rendering a graphical user interface (GUI) on a mobile device 420 via the public access network. The GUI is configured for displaying a well depth corresponding to the depth sensor, and receiving a pump control signal. The pump 122 is responsive to the pump control signal for energizing or deenergizing the pump. The GUI, as well as monitor LEDs 422-1 . . . 422-3 can relay the operational state from FIG. 3 indicative of sufficient depth 422-1, alarm depth 422-2, and shutoff 422-3. Other GUI functions may be envisioned, such as queries of trend analysis and aquifer characteristics from multiple well sites, depicted in FIG. 5 below. A desktop/mobile phone application 421 and GUI may provide similar rendering capabilities.

During normal operation, the monitor 132 iterates according to the control logic of FIG. 3, as encoded in a memory 440 and a processor 450. The pump control further comprises a power switch for activating and deactivating the pump, the monitor 132 has logic for indicating an excessively low water depth in the well 120, and for deactivating the pump. When called for, the monitor 132 sends a deactivation signal 451 to a switch or relay 452 for opening an electrical supply circuit to the pump. This is generally a relay switch to terminate 220-volt or 110-volt pump motor power when a control module automatic or user-controlled pump shut-down is triggered, Other features and elements employed by the monitor include:

a. A remote user-controlled relay switch to bypass the control module to allow the well to operate in a routine, uninterrupted manner during control module maintenance, replacement or malfunction,
b. LED status lights 422 on the control enclosure showing various different colors depending on the system's readiness, alarm and bypass or shut-down status,
c. A small PTC ("positive temperature coefficient") control module heater 410 to maintain a minimum control module temperature to ensure performance during cold weather,
d. 220-volt AC or 110-volt AC to -24-volt DC transformer 412 (depending on well pump power voltage) to power the low voltage transducer, control module, and enclosure heater,
e. A digital signal output ethernet cable (supplied by others) 414 and wireless/cellular router to a local personal computer modem and/or to the internet over a cellular network,
f. Weather-proof deep water pressure-proof cable connectors and other components,
g. A lockable Hoffman®-type (or equivalent) control enclosure box mounted near or on the wellhead. A well casing cap incorporating weather-proof power and signal cable penetrations.

FIG. 5 shows an accumulation of well data by the monitor device of FIGS. 1-4. Iterative depth signals 152 received by the memory 440 in the monitor circuit populate a history log 500 configured for storing a series of the depth signals, such that each of the depth signals is gathered based on corresponding time intervals 502 and stored with the corresponding intervals for well parameters 504 and well characteristics 506. This may also include an interface to the remote database 105 and server 104, where the database is responsive to a plurality of monitoring circuits, each connected to a respective depth sensor in a corresponding well 120-N. The chart of FIG. 5 shows a range of fields collectable and/or computable based on the depth signals and corresponding time and aquifer characteristics.

Figure 6:
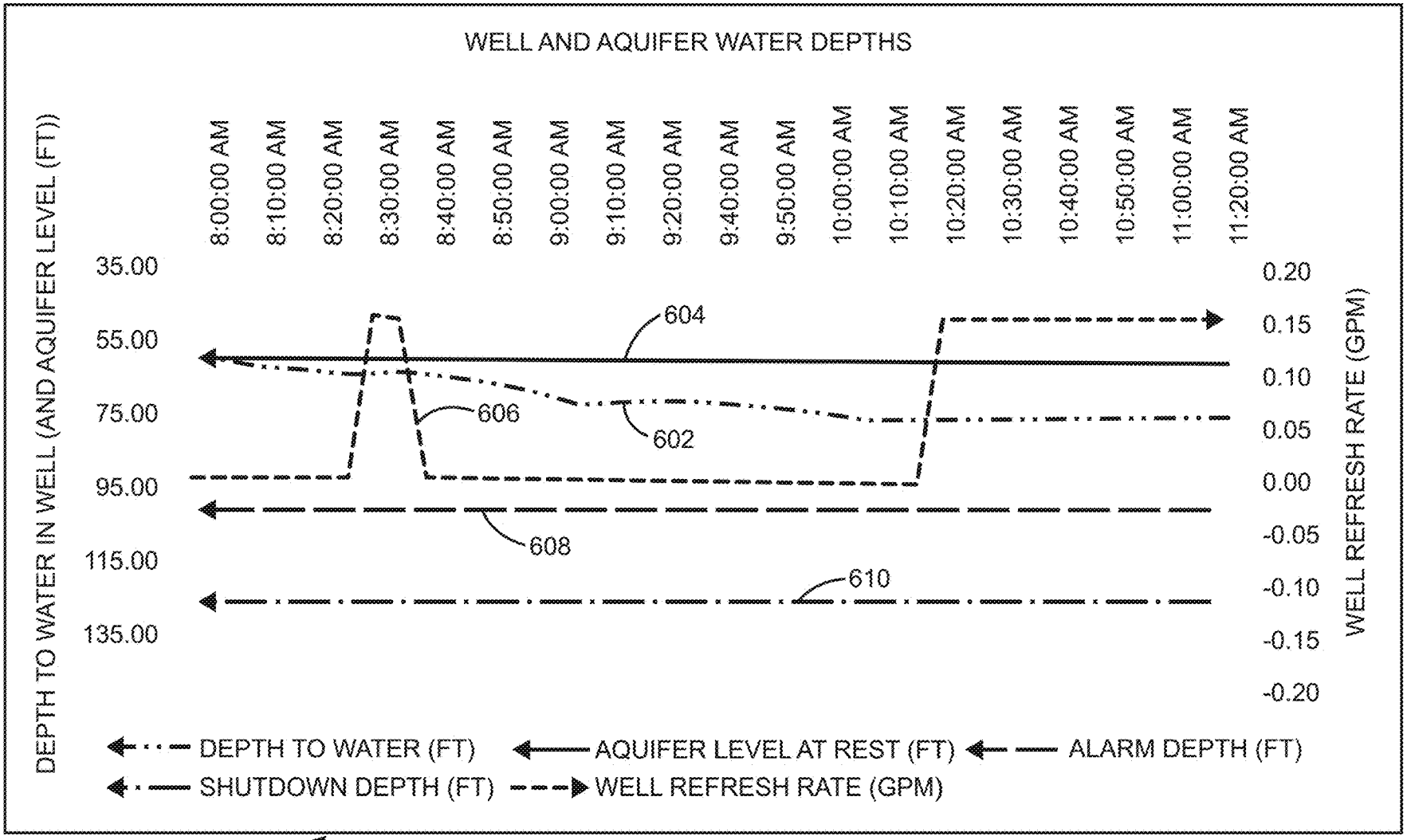
FIG. 6 shows a GUI (Graphical User Interface) rendering trending analysis using the accumulated well data of FIG. 5.

FIG. 6 shows a GUI (Graphical User Interface) rendering a trending analysis 600 using the accumulated well data of FIG. 5. Most prominently, a well depth 602 over time shows the water level above the pump, which is the primary determiner of pump burden. This is related to the aquifer level at rest 604, a refresh rate 606 from the aquifer as the pump draws, the warning depth 608 and the alarm depth 610. Such information may be provided to an analytics processor connected to the database, Other inputs to the analytics processor may include a map for identifying a location of each of the corresponding wells, and instructions for computing a subset of the wells drawing from a common aquifer as a source, meaning adjacent wells "in competition" for the same aquifer. Instructions for computing longer term waterflow trends also may be generated from a series of depth signals received from the respective depth sensors in the subset.

Those skilled in the art should readily appreciate that electronic logic and instructions as disclosed herein are open to implementation in many forms, including but not limited to a) information permanently stored on non-writeable storage media such as ROM devices, b) information alterably stored on writeable non-transitory storage media such as floppy disks, magnetic tapes, CDs, RAM devices, and other magnetic and optical media, or c) information conveyed to a computer through communication media, as in an electronic network such as the Internet or telephone modem lines. The operations and methods may be implemented in a software executable object or as a set of encoded instructions for execution by a processor responsive to the instructions. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A well monitor device, comprising:

a depth sensor adapted to be disposed in a well having a pump, the depth sensor configured to send a depth signal in response to stimuli in the well;

a monitor circuit, the depth sensor connected to the monitor circuit for transmitting the depth signal to the monitor circuit; and an interface to a pump control, the interface responsive to the monitor circuit for energizing the pump;

an interface to a database, the database responsive to a plurality of monitoring circuits, each monitoring circuit connected to a respective depth sensor in a corresponding well; and a current sensor engaged with a pump power cable, the current sensor configured to provide a signal indicative of pump operation based on a current draw, the database further comprising a table for storing an indication of timed intervals of pump operation and a depth level in the well.

2. The device of claim 1 wherein the sensor is a pressure sensor, the pressure sensor responsive to hydrostatic pressure in the well based on a depth of an aquifer supply sourced by the well.

3. The device of claim 1 wherein the depth signal is a variable electric signal having a value proportional to a depth of a liquid in the well.

4. The device of claim 1 further comprising one or more depth control thresholds in the monitor circuit, the monitor circuit having depth logic for:

comparing the depth signal to the depth control threshold; and performing at least one of triggering alarms and de-activating the pump based on the comparison.

5. The device of claim 1 wherein the interface to the pump control further comprises a power switch for activating and deactivating the pump, the monitor circuit having logic for indicating an excessively low water depth in the well, deactivating the pump, and if the water depth in the well is sufficiently deep, activating the pump.

6. The device of claim 1 further comprising:

a memory in the monitor circuit, the memory having a history log, the history log configured for storing a series of the depth signals, each of the depth signals gathered based on an interval and stored with the corresponding interval.

7. The device of claim 1 further comprising:

a pump power cable, the pump power cable connected to the pump in the well and adapted to energize the pump by conducting electrical power to the pump; and a signal cable, the signal cable adjacent the pump power cable and connected to the depth sensor, the depth sensor disposed at a predetermined position along the pump power cable, the predetermined position defined by an expected range of water depth within the well.

8. The device of claim 1 further comprising:

an interface to a public access network; and instructions for rendering a graphical user interface (GUI) on a mobile device via the public access network, the GUI configured for:

displaying a well depth corresponding to the depth sensor; and receiving a pump control signal, the interface to the pump control responsive to the pump control signal for energizing or deenergizing the pump.

9. The device of claim 1 wherein the depth sensor includes a pressure-sensing transducer element and the depth signal is a variable current signal based on hydrostatic pressure exerted on the pressure-sensing transducer element.

10. The device of claim 1 wherein the depth sensor is adapted for detection of water at a depth of up to 500 feet.

11. A well monitor device, comprising:

a depth sensor adapted to be disposed in a well having a pump, the depth sensor configured to send a depth signal in response to stimuli in the well;

a monitor circuit, the depth sensor connected to the monitor circuit for transmitting the depth signal to the monitor circuit;

an interface to a pump control, the interface responsive to the monitor circuit for energizing the pump;

an interface to a database, the database responsive to a plurality of monitoring circuits, each monitoring circuit connected to a respective depth sensor in a corresponding well; and an analytics processor connected to the database, the analytics processor including:

a map for identifying a location of each of the corresponding wells;

instructions for computing a subset of the wells drawing from a common aquifer as a source; and instructions for computing waterflow trends from a series of depth signals received from the respective depth sensors in the subset.

12. A method for pump control, further comprising:

establishing a depth value indicative of a low depth level in the well, the low depth level based on a probability of pump damage from continued operation beyond the low depth level;

receiving a depth signal from a depth sensor in the well, the depth signal indicative of a depth of water in the well;

comparing the depth signal to the established depth value;

invoking a remedial action based on the comparison;

transmitting an indication of the depth signal to a database, the database responsive to a plurality of monitoring circuits, each monitoring circuit connected to a respective depth sensor in a corresponding well; and transmitting, from a current sensor engaged with a pump power cable, a signal to the database indicative of pump operation based on a current draw, the database further comprising a table for storing an indication of timed intervals of pump operation and a depth level in the well.

13. The method of claim 12 wherein the remedial action includes at least one of:

deactivating the pump, and transmitting a signal indicative of the comparison.

14. The method of claim 12 wherein the remedial action further comprises:

sending a deactivation signal to a switch or relay for opening an electrical supply circuit to the pump.

15. The method of claim 12 wherein the established depth value further comprises a plurality of depth values, the plurality of depth values including:

a warning depth level, indicative of a depth level approaching a non-operative limit; and a low depth level, indicative of a need to de-energize the pump to prevent pump damage.

16. The method of claim 12 further comprising:

deploying a depth sensor in proximity to a well pump by attaching the depth sensor to the discharge pipe connected to the pump at a predetermined distance from the pump; and calibrating the depth sensor for sensing the depth based on the height of water above the sensor.

17. The method of claim 12 further comprising receiving the depth value from a GUI on a mobile device or via a network to a computer.

18. A system for monitoring aquifer health, comprising:

a depth sensor adapted to be disposed in a well having a pump, the depth sensor configured to send a depth signal in response to stimuli in the well;

a monitor circuit, the depth sensor connected to the monitor circuit for transmitting the depth signal to the monitor circuit;

an interface to a pump control, the interface responsive to the monitor circuit for energizing the pump;

an interface to a database, the database responsive to a plurality of monitoring circuits, each monitoring circuit connected to a respective depth sensor in a corresponding well; and an analytics processor for computing waterflow trends from a series of depth signals received from a plurality of respective depth sensors, the analytics processor including:

a map for identifying a location of each of the corresponding wells;

instructions for computing a subset of the wells drawing from a common aquifer as a source; and instructions for computing waterflow trends from a series of depth signals received from the respective depth sensors in the subset.

* * * * *